US008875917B2

(12) United States Patent
Lourenco et al.

(10) Patent No.: US 8,875,917 B2
(45) Date of Patent: Nov. 4, 2014

(54) CLOSURE CAP WITH SPRING ELEMENT FOR A CONTAINER

(75) Inventors: Armindo Lourenco, Noyelles-Godault (FR); Vincent Sebille, Etampes (FR)

(73) Assignee: Clariant Production (France) SAS, Choisy le Roi (FR)

( * ) Notice: Subject to any disclaimer, the term of this patent is extended or adjusted under 35 U.S.C. 154(b) by 109 days.

(21) Appl. No.: 12/992,657

(22) PCT Filed: May 15, 2008

(86) PCT No.: PCT/EP2008/055994

§ 371 (c)(1),
(2), (4) Date: Nov. 15, 2010

(87) PCT Pub. No.: WO2009/138128

PCT Pub. Date: Nov. 19, 2009

(65) Prior Publication Data

US 2011/0062176 A1 Mar. 17, 2011

(51) Int. Cl.
*B65D 51/26* (2006.01)
*B65D 51/30* (2006.01)

(52) U.S. Cl.
CPC ..... *B65D 51/30* (2013.01); *B65D 51/26* (2013.01); *B65D 2101/0023* (2013.01); *B65D 41/0809* (2013.01)
USPC ..... 215/231; 215/287; 220/839

(58) Field of Classification Search
USPC ..... 220/212, 837, 839, 87.1; 206/204, 535, 206/528, 814; 215/235, 231, 228; 222/556
See application file for complete search history.

(56) References Cited

U.S. PATENT DOCUMENTS

| | | | | |
|---|---|---|---|---|
| 4,899,897 | A * | 2/1990 | Buttiker et al. | 215/228 |
| 7,413,083 | B2 * | 8/2008 | Belfance et al. | 206/540 |
| 7,661,547 | B2 * | 2/2010 | Richir | 215/225 |
| 2007/0084735 | A1 | 4/2007 | Lancesseur et al. | |
| 2007/0170193 | A1 | 7/2007 | Schorner | |
| 2010/0044252 | A1 * | 2/2010 | Portier et al. | 206/204 |

FOREIGN PATENT DOCUMENTS

| | | |
|---|---|---|
| DE | 102005059675 | 6/2007 |

* cited by examiner

*Primary Examiner* — Anthony Stashick
*Assistant Examiner* — Raven Collins
(74) *Attorney, Agent, or Firm* — Scott R. Cox

(57) ABSTRACT

The present invention pertains to a closure cap for a container, the closure cap including a top part connectable to a container body via a hinge, the top part being pivotable about the hinge. The top part further includes a sealing skirt to sealingly engage with an opening of the container body, and the top part includes a desiccant chamber for accommodating a desiccant. A spring element for pre-tensioning products received in the container body, the spring element extending from the top part in a single loop, is also an element of the container.

10 Claims, 3 Drawing Sheets

32
36
360
38
380
4
30
2
34
322

1
20
2
22
30
31
34
32
40
320
38
42
36
360
4

CLOSURE CAP WITH SPRING ELEMENT FOR A CONTAINER

1. TECHNICAL FIELD

The present invention relates to a closure cap for a container, wherein the container typically receives loosely stored products such as pills or tablets, in particular effervescent tablets. The closure cap comprises a top part connected to a container body via a hinge, wherein the top part includes a sealing skirt to sealingly engage with an opening of the container body, and the top part includes a desiccant chamber for accommodating a desiccant, according to the preamble of claim 1.

2. PRIOR ART

Closure caps for containers of the above-mentioned type are known and common to the skilled persons.

WO 2005/012131 A2 relates to a container for packaging products which are sensitive to a moist environment. The container comprises a closure cap including a desiccant chamber.

Closure caps for containers of the above-mentioned type are typically manufactured or molded separately from the container body. The closure caps are then connected to the container body after the products to be stored, in particular pills or tablets, have been introduced into the container body. The container body is typically a cylindrical tube having one opening at one end face and which is closed at the opposite end face. Effervescent tablets, which are particularly sensitive to moisture, are typically contained in containers of this type.

After the tablets have been introduced into the respective container body, the closure cap is attached to the container body, conventionally by positive locking.

The closure cap of this type may comprise a ring part which snaps over a bead around the opening of the container body and which connects the top part firmly to the container body by positive locking.

In order to sealingly close the container, the top part may include a sealing skirt which fits with its outer wall surface snugly into the inner wall surface of the opening of the container body.

In particular, in the case of effervescent tablets, the products are very sensitive to moisture. In order to increase the shelf life, a desiccant chamber may be included in the closure cap. Furthermore, as soon as the container is opened by a customer for the first time, moisture enters into the inside of the container body. Into the desiccant chamber, a desiccant such as silica gel, a molecular sieve or any other drying agent is provided in order to ensure that the quality of the products within the container can be maintained over a long period of time and over repeated opening and closing cycles.

3. SUMMARY

It is an objective of the present invention to provide a closure cap for a container which has an improved storage performance and which can be manufactured in a cost efficient manner.

This object is achieved by a closure cap with the features of claim 1. Advantageous improvements are claimed in the dependent claims.

According to the preamble of claim 1, a closure cap for a container comprises a top part connected to a container body via a hinge, the top part being pivotable about the hinge and the top part including a sealing skirt to sealingly engage an opening of the container body. Furthermore, the top part includes a desiccant chamber for accommodating a desiccant; and a spring element for pre-tensioning products received in the container body is provided.

According to the invention the spring element extends from the top part in a single loop. In this disclosure, the term "single loop" is to be understood in the sense that the spring element does neither branch off nor has more than one single band of material. In particular, the term "single loop" is intended to mean that the spring element extends from the top part and ends at the top part, not showing more than one single winding. The term "loop" does, however, not necessarily mean that the loop is closed and open loops are also contemplated. In particular, an open loop having at least one gap is also understood to be included in the definition of "single loop".

By the provision of the spring element in this form, in particular in the form of a single loop that extends from the top part, the spring element can be provided in a cost efficient manner. Furthermore, it improves the storage characteristics of the closure cap as the spring element pre-tensions the products received in the container body, in particular the tablets or pills, such that they do not move around during transport and, thus, do not break or dust.

Further, according to the invention, the single loop of the spring element has a diameter larger than the diameter of the desiccant chamber and/or a diameter larger than the sealing skirt. This enables an easy access to the desiccant chamber such that the desiccant can be easily introduced into the desiccant chamber without being hindered by the spring element.

Furthermore, the desiccant, once introduced into the desiccant chamber, needs to be closed in, typically by using a piece of paperboard. This piece of paperboard is conventionally attached to the walls of the desiccant chamber by means of heat welding. The spring according to the invention has the advantage that a welding gun can be easily introduced through the spring in order to heat weld the paperboard to the desiccant chamber.

Furthermore, a specific embodiment enables that the spring element is made in one piece with the closure cap, as there is no need to remove the spring element for inserting a desiccant into the desiccant chamber.

In a preferred embodiment, the spring element extends from the end face of the desiccant chamber or from the end face of the sealing skirt. In a further preferred embodiment, the walls of the desiccant chamber are identical with the walls of the sealing skirt such that the outer wall surface of the sealing skirt adopts the function of sealingly engaging with the inner surface of the container body, and the inner wall surface of the sealing skirt defines the desiccant chamber. In such an embodiment, it is appropriate that the spring extends from the end face of the sealing skirt.

Preferably, the spring element is made in one piece, or integrally, with the closure cap. This embodiment reduces the number of parts, reduces the assembly cost and the overall cost of the closure cap. It furthermore improves the handling of the closure cap as there is one piece less to be assembled when filling the container body and the desiccant chamber.

In a preferred embodiment, the spring element extending in a single loop, extends from the top part and ends at the top part such that the two base portions are situated in a sector of a circle of less than 90 degrees of the top part. Preferably, the sector is situated opposite to the sector in which the hinge is situated. This embodiment enables that the spring element can be shaped in a form such that it makes maximum use of a length extending from the top part.

In particular, the spring element can be shaped such that the single loop is bent substantially about the hinge axis, in particular in a plane perpendicular to the hinge axis, such that the spring element is basically bent backwards towards the hinge. In particular, the spring element describes some sort of radius about the hinge axis.

This shape of the spring element enables the provision of a comparatively long spring element that makes maximum use of the opening in the container body. In other words, by shaping the spring element in a bent form, substantially bent about the hinge axis, it is possible to provide a spring element that is long, yet the top part can be opened without the spring element touching the inner surface of the container body.

The length of the spring element according to this embodiment has the advantage that the spring element has an increased travel, resulting in a situation in which tolerances in the products, e.g. tolerances in the thickness of the tablets, can be easier accommodated for and the closure cap can be used for a larger range of different products, e.g. different thicknesses of tablets. This has the advantage that a reduced number of different lengths for the container bodies can be used in order to accommodate different products, or that a larger range of products can be accommodated in a given range of lengths of container bodies.

In a preferred embodiment, the spring element is shaped in the form of a single band, extending from a position substantially opposite the position of the hinge, looping around the outside of the desiccant chamber and extending back to the top part in a position likewise substantially opposite to the hinge, wherein the single loop also extends beyond the extension orthogonal to the surface of the top part, and in particular substantially beyond the end face of the desiccant chamber.

4. BRIEF DESCRIPTION OF THE DRAWINGS

Further advantages, details and characteristics can be derived from the following description of embodiments of the invention by means of exemplary drawings.

The invention will be explained below in more detail with reference to the Figures.

5. DETAILED DESCRIPTION OF PREFERRED EMBODIMENTS

Figure 2:
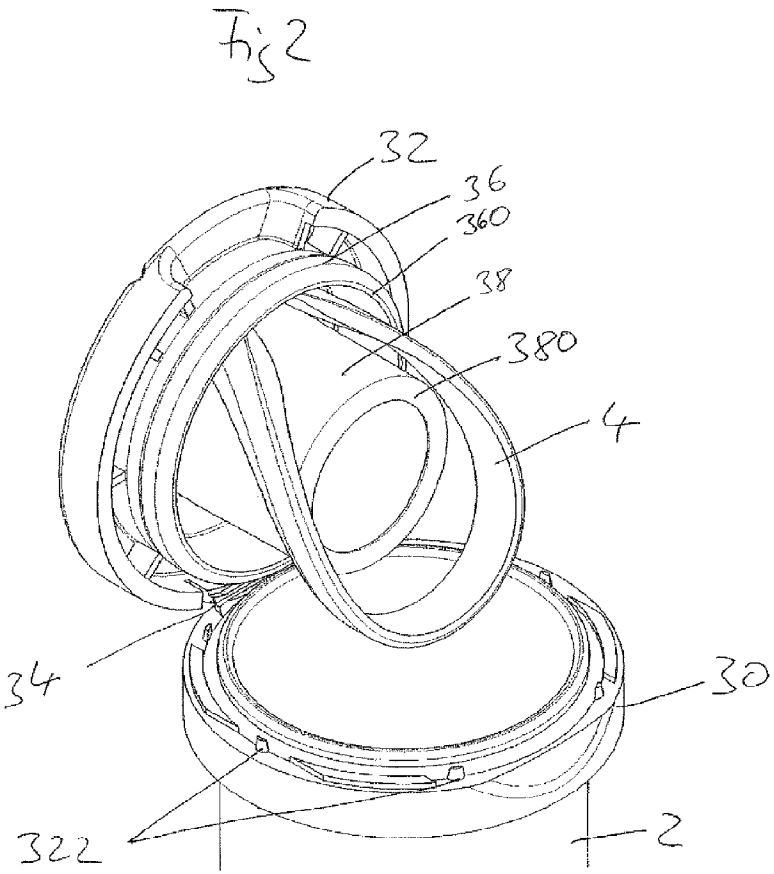
FIG. 2 is a perspective schematic view of the closure cap mounted to the container body.

In the following description, like elements are indicated by identical reference numerals and repeated description of the respective elements is omitted.

Figure 1:
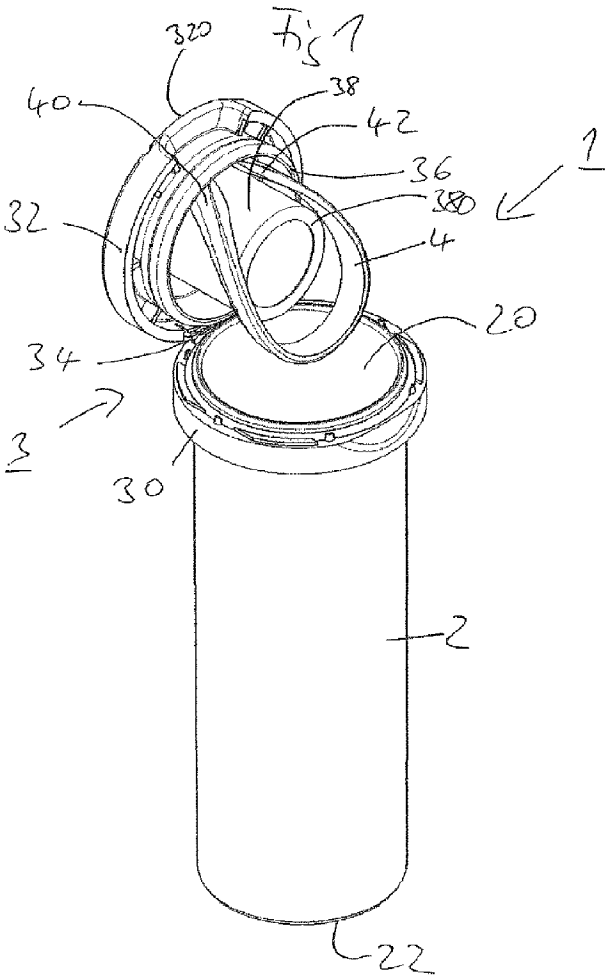
FIG. 1 is a perspective schematic view of a container including a container body and a closure cap according to a first embodiment.

FIGS. 1 and 2 show in schematic perspective views a container 1 having a container body 2 and a closure cap 3. The closure cap 3 is fixedly attached to the container body 2 in the area of an opening 20 of the container body in order to close the opening 20. The container body 2 has a substantially cylindrical form and, opposite to the opening 20, a closed bottom 22. The inner diameter of the container body is substantially constant, such that tablets of a constant diameter can be received inside the container body 2.

The closure cap 3 includes a ring part 30 which is fixedly connected to the container body 2, and a top part 32 which is connected to the ring part 30 via a hinge 34 and which is pivotable about the hinge 34. The hinge 34 can be a foil hinge, such that the top part 32, the ring part 30 and the hinge 34 can be made in one piece.

The top part 32 includes a sealing skirt 36 which has an outer diameter which is dimensioned to sealingly engage with the opening 20 of the container body.

A desiccant chamber 38 is integral with the top part 32 and extends perpendicular to the general extension of the top part 32, which is schematically shown as the top surface 320. In particular, the desiccant chamber 38 extends in the same direction as the sealing skirt 36. The desiccant chamber 38 serves to accommodate a desiccant, for example a silica gel, calcium chloride, a molecular sieve, other drying agents or any mixtures thereof.

The drying agents that are to be received in the desiccant chamber 38 serve to remove moisture from the inside of the container body 2 in order to keep the products inside the container body 2 dry. This is of relevance in order to increase the shelf life of the products and in order to preserve the products even if the container or the closure cap were slightly moisture permeable and/or if some moisture was introduced during the filling of the container. The provision of the desiccant chamber is also of relevance when a consumer opens the container 1 in order to remove a product and then recloses the container. Repeated opening and closing of the container may introduce substantial amounts of moisture into the inside of the container.

A spring element 4 for pre-tensioning products received in the container body 2 extends from the top part 3 in a single loop. In particular, the spring element 4 is made in the form of a single leg or single band extending from the top part 32 in a single loop, basically around the desiccant chamber 38 and back to the top part 32. At the same time, the spring element extends in a direction perpendicular to the general plane of the top part 32, i.e. in the same direction as the desiccant chamber 38 as well as the sealing skirt 36. However, the spring element 4 extends substantially beyond the end face 380 of the desiccant chamber 38.

The spring element 4 comprises a first base portion 40 and a second base portion 42 which are both situated at the top part 32. Both base portions 40, 42 are situated between the outer diameter of the desiccant chamber 38 and the inner diameter of the sealing skirt 36. The first base portion 40 and the second base portion 42 are both situated in a single sector of a circle that has a radial extension of less than 90 degrees. The two base portions 40, 42 are situated in a sector opposite to the sector of the top part 32 in which the hinge 34 is situated.

In a further embodiment, which is not shown, it is contemplated that the base portions 40, 42 are situated on the end face 380 of the desiccant chamber 38, or on the end face 360 of the sealing skirt 36. It is even contemplated integrating the sealing skirt 36 and the desiccant chamber 38 such that the outer wall surface of the sealing skirt 36 has the function of sealingly engaging with the inner wall of the container body 2 and the inner wall surface of the sealing skirt 36 defines the desiccant chamber.

The spring element 4 has, thus, as it also extends around the desiccant chamber 38, a shape in which it is basically bent backwards towards the hinge 34. In particular, the spring element 4 is substantially bent about the hinge axis.

Figure 5:
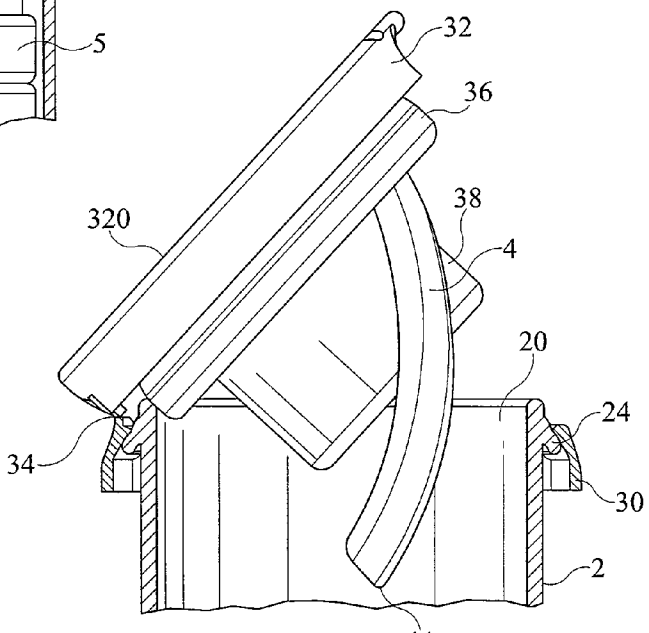
FIG. 5 is a schematic cross-section of the closure cap in a semi-opened position.

Due to this bending of the spring element 4 about the hinge axis, as can be seen in FIG. 5, the opening and closing of the top part 32 can be achieved without the spring element 4 touching the inner wall surface of the container body 2.

In other words, the extension between the general extension of the top part 32 and the lowest tip 44 of the spring element 4 can be increased due to the asymmetric position of the lowest tip 44. Compared to the common arrangements in which the spring elements are e.g. concentric or conic, a substantially longer spring element can be provided.

Accordingly, the desiccant chamber 38 can also be made longer and, thus, includes a larger volume than in conventional arrangements.

The substantially longer spring element results in increased travel of the spring element such that different products or larger tolerances can be accommodated for using the same configuration of closure cap 3 and container body 2. In other words, the number of different lengths for container bodies used for a selected number of products can be lowered, or the number of different products that can be accommodated in the container can be increased when using the closure cap according to the embodiment described.

As the spring element 4 extends, in an axis perpendicular to the top surface 320 of the top part 32 and concentric to it, substantially around the desiccant chamber 38, the desiccant chamber is easily accessible even if the spring element 4 is present.

Figure 4:
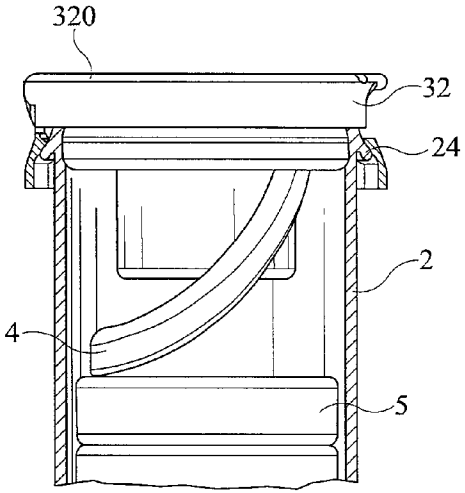
FIG. 4 is a schematic cross-section of the container body with products received therein in a closed position of the closure cap.
Figure 3:
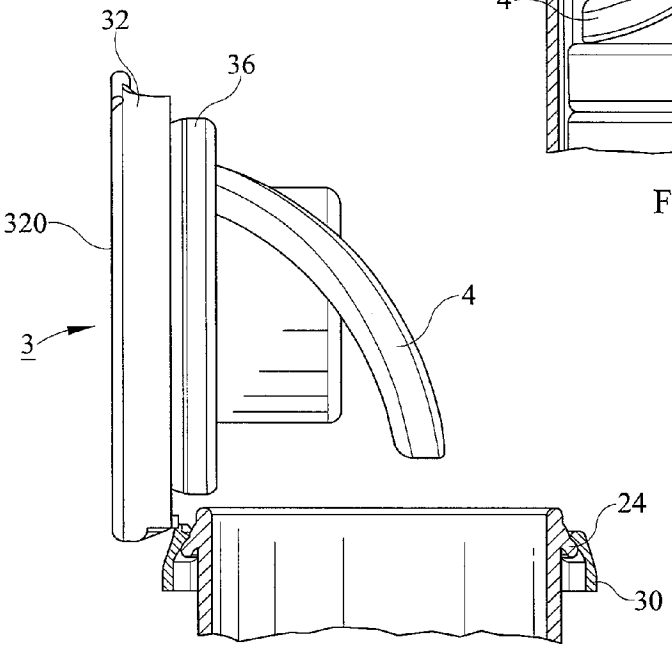
FIG. 3 is a schematic side view with the container in cross-sectional view and the closure cap in a side view.

In FIGS. 3 to 5, it can be clearly seen that the container body 2 comprises a bead 24 which serves to lockingly receive the ring element 30 of the closure cap 3. The ring element 30 is preferably clicked (positive fit) onto the bead 24.

In FIG. 2, tamper evident webs 322 are shown which connect the top part 32 with the ring part 30 after the container 1 has been filled with the products. The customer that opens and closes the closure cap, or rather the top part 32 of the closure cap, in order to retrieve the products inside the container 1 for the first time, has first to break the tamper evident webs 322. Accordingly, if the tamper evident webs 322 are intact, the customer can be sure that the products inside the container have not been tampered with.

Figure 6:
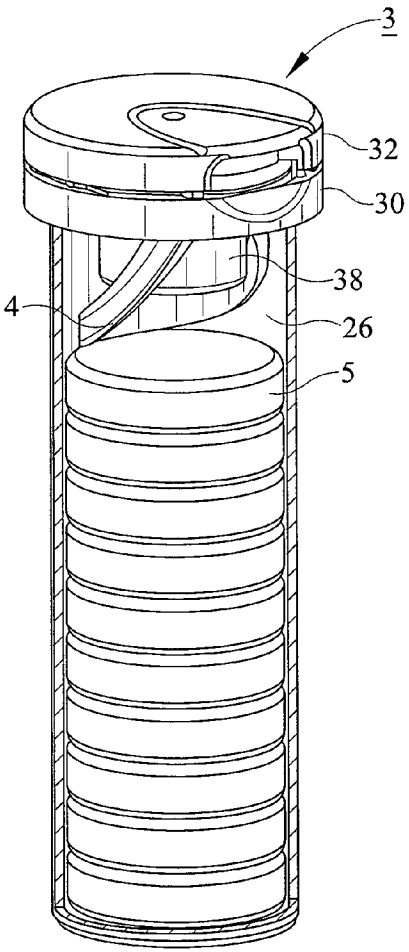
FIG. 6 is a schematic detailed view of the container.

In FIG. 6, the container 1 is shown with products 5, for example in the form of effervescent tablets, inside the container body 2. It can be seen that the tablets 5 are pre-tensioned, or pressed down, by the spring element 4 and that the desiccant chamber 38 is open into the volume 26 that is present between the tablets 5 and the top part 32 of the closure cap 3.

In the embodiment shown in FIGS. 1 to 6, the spring element 4 is made in the form of a single band made from the same material as that of the whole closure cap 3. There are no branching-off elements and there are no third elements to this spring element. The term "single loop" does, however, not imply that it is a closed loop. In other words, the base portions 40, 42 of the spring element 4 can be positioned apart from one another, as it is show in the FIGS. 1 to 6. There is, however, not more than a single winding to this spring element.

Figure 7:
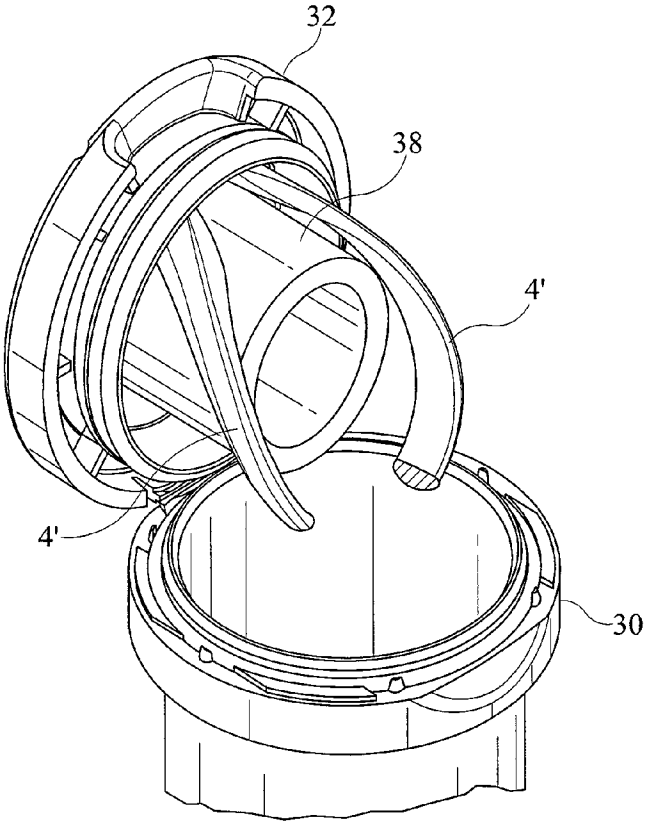
FIG. 7 is a schematic view of an open spring element according to a second embodiment.

In a second embodiment shown in FIG. 7, the spring element 4' is provided with a gap in the region of the tip of the spring element 4'. This embodiment is also regarded to be included in the term "single loop" as there are no branching-off or crossing strands of the spring element and as the spring element does not extend more than a single winding around the desiccant chamber 36.

The invention claimed is:

1. A closure cap for a container, the closure cap comprising:

a top part connectable to a container body via a hinge, the top part being pivotable about the hinge;

the top part including a sealing skirt to sealingly engage with an opening of the container body and further comprising a top wall;

the top part further comprising a desiccant chamber for accommodating a desiccant, and further comprising a spring element for pre-tensioning products received in the container body, wherein the spring element extends directly from and ends at the top wall of the top part to form a single loop, does not comprise more than a single winding, and neither branches off nor consists of more than a single band of material, wherein the loop of the spring element has a diameter larger than a diameter of the desiccant chamber, wherein the spring element has two base portions, which are situated between an inner diameter of the sealing skirt and an outer diameter of the desiccant chamber, wherein the loop has a stand-alone structure with respect to the closure cap, and wherein there is no other structure connecting the loop to the closure cap.

2. The closure cap according to claim 1, wherein the spring element is made in one piece with the top part.

3. The closure cap according to claim 1, wherein the base portions are situated in a sector of a circle having a radial extension of less than 90 degrees, wherein the base portions are situated in a sector opposite the sector of the top part at which the hinge is situated.

4. The closure cap according to claim 1, wherein the spring element is bent about an axis of the hinge in a plane perpendicular to the hinge axis.

5. The closure cap according to claim 4, wherein the spring element describes a radius about the hinge axis.

6. The closure cap according to claim 1, wherein the desiccant chamber is freely accessible despite the spring element.

7. The closure cap according to claim 1, wherein the closure cap further comprises a ring part connected to the container body, wherein the top part is connected to the ring part via the hinge.

8. A container comprising a closure cap and a container body, wherein the closure cap comprises a top part and a ring part, wherein the ring part is connected to the container body and the top part is connected to the ring part via a hinge, the top part being pivotable about the hinge;

the top part including a sealing skirt to sealingly engage with an opening of the container body and further comprising a top wall;

the top part further comprising a desiccant chamber for accommodating a desiccant, and further comprising a spring element for pre-tensioning products received in the container body, wherein the spring element extends directly from and ends at the top wall of the top part to form a single loop, does not comprise more than a single winding, and neither branches off nor consists of more than a single band of material, wherein the loop of the spring element has a diameter larger than a diameter of the desiccant chamber, wherein the spring element has two base portions, which are situated between an inner diameter of the sealing skirt and an outer diameter of the desiccant chamber, wherein the loop has a stand-alone structure with respect to the closure cap, and wherein there is no other structure connecting the loop to the closure cap.

9. The container according to claim 8, wherein the container body comprises a substantially cylindrical container body having an opening, wherein the closure cap is situated such that it closes the opening.

10. A closure cap for a container, the closure cap comprising:

a top part connectable to a container body via a hinge, the top part being pivotable about the hinge;

the top part including a sealing skirt to sealingly engage with an opening of the container body and further comprising a top wall;

the top part further comprising a desiccant chamber for accommodating a desiccant, and further comprising a spring element for pre-tensioning products received in the container body, wherein the spring element extends directly from and ends at the top wall of the top part in a single loop, and wherein the spring element consists of only a single loop, wherein the loop of the spring element has a diameter larger than a diameter of the desiccant chamber, wherein the spring element has two base portions, which are situated between an inner diameter of the sealing skirt and an outer diameter of the desiccant chamber, wherein the loop has a stand-alone structure with respect to the closure cap, and wherein there is no other structure connecting the loop to the closure cap.

* * * * *